US005649553A

United States Patent [19]

Pillai et al.

[11] Patent Number: 5,649,553

[45] Date of Patent: Jul. 22, 1997

[54] MAKING TOBACCO ROD

[75] Inventors: Santosh Kumar Pillai, Camberley; William John Stone, Southampton, both of United Kingdom

[73] Assignee: British-American Tobacco Company Limited, Staines, England

[21] Appl. No.: 641,419

[22] Filed: May 1, 1996

[30] Foreign Application Priority Data

Jan. 26, 1994 [GB] United Kingdom ..... 9401458

[51] Int. Cl.[6] ..... A24B 3/18

[52] U.S. Cl. ..... 131/294; 131/84.1

[58] Field of Search ..... 131/294, 295, 131/299, 84.1, 108

[56] References Cited

U.S. PATENT DOCUMENTS

| | | | |
|---|---|---|---|
| 3,409,022 | 11/1968 | Zygmunt de la Burde | 131/294 |
| 3,664,351 | 5/1972 | Russell | 131/84.3 X |
| 3,785,384 | 1/1974 | Sylvester et al. . | |
| 4,488,562 | 12/1984 | Remington | 131/84.1 |
| 4,922,933 | 5/1990 | Jakob | 131/294 X |
| 5,139,035 | 8/1992 | Lasch et al. | 131/294 X |

FOREIGN PATENT DOCUMENTS

| | | |
|---|---|---|
| 499764 | 1/1939 | Germany . |
| 1276496 | 6/1972 | United Kingdom . |
| 2184335 | 6/1987 | United Kingdom . |

*Primary Examiner*—Jennifer Bahr

*Attorney, Agent, or Firm*—Kane, Dalsimer, Sullivan, Kurucz, Levy, Eisele and Richard

[57] ABSTRACT

The invention provides a method of making tobacco rod in which method the tobacco filler material of the rod is subjected to radio frequency heating before feeding to a rod making machine. The elevated temperature increases the pliability of the tobacco filler, thus reducing its degradation in the rod making machine and enhancing the physical properties, e.g. ends stability, of the tobacco rods thus produced.

7 Claims, 1 Drawing Sheet

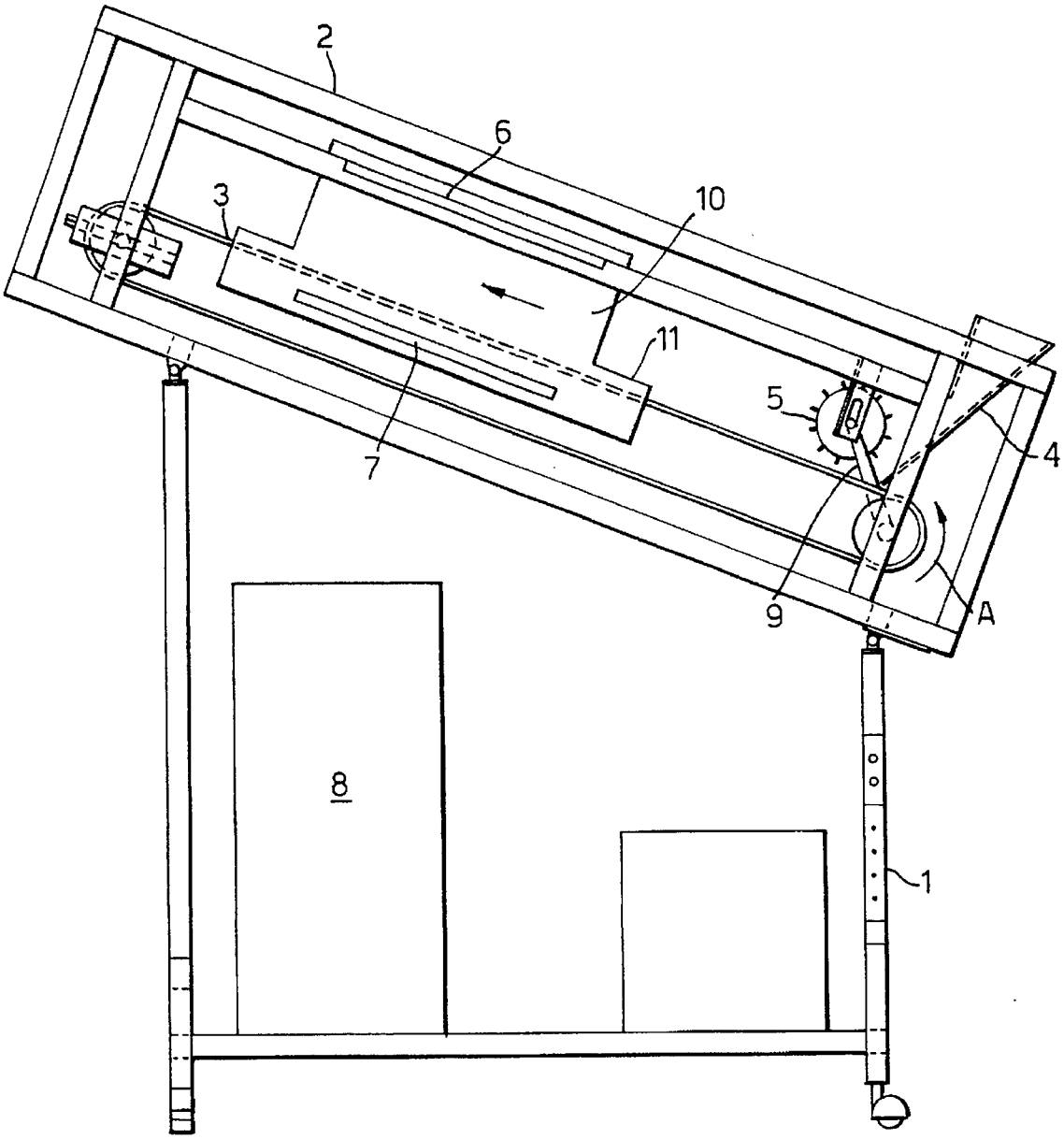
2
6
3
10
11
5
4
7
9
A
8
1

MAKING TOBACCO ROD

BACKGROUND OF THE INVENTION

1. Field of the Invention

The subject invention relates to the making of tobacco rod, cigarette tobacco rod for example.

2. Brief Description of the Related Art

In the commercial manufacture of cigarettes, cigarette tobacco rod is conventionally made on a rod making machine, a machine supplied by, for example, G. D. S.p.A., Korber A G or Molins P L C. Such rod making machines comprise a hopper, a carding unit, a garniture and a cut-off device. In the operation of such a machine the hopper receives tobacco filler material and serves to hold a reservoir supply thereof. The carding unit receives tobacco filler material from the hopper and serves to disentangle entangled filler material and to provide an even supply of the filler material for feed to the garniture. Within the garniture the filler material is enwrapped in a web of cigarette paper, which paper is supplied from a bobbin thereof. There thus continuously exits the garniture a tobacco rod, which rod runs through the cut-off device, wherein the rod is severed to provide discrete sections of cigarette rod length.

Owing to the considerable degree of handling to which the tobacco filler material is subjected during the passage thereof through a rod making machine, the filler suffers degradation such that a proportion of the filler is of less than optimum or adequate particle size for the making of cigarette rod.

In the specification of U.S. Pat. No. 3,664,351 there is described a proposal for effecting a reduction in the degradation to which tobacco filler is subjected during the passage thereof through the garniture of a rod making machine. According to this proposal, the filler, after passing through the carding unit, is pneumatically transported, in an upward direction, through a narrow arcuate path to a suction band, which band serves to transport a carpet of the filler to the entry end of the garniture. During the passage of the filler through the said arcuate path the filler is subjected to microwave frequency heating, this being with a view to effecting an enhancement of the pliability of the tobacco particles and hence a reduction in the degree of degradation suffered by the filler during passage through the garniture.

The proposal of U.S. Pat. No. 3,664,351 is attended by a number of disadvantages. In that the arcuate path extending to the suction band is very narrow (8 mm), and in that there are direction changes at the entry and exit of the path (to prevent or reduce radiation escape), the provision of the path itself leads to degradation of the tobacco. Furthermore, the direction change at exit from the arcuate path causes blockages to occur and within a few seconds (not more than about ten) the tobacco in such a blockage becomes charred, i.e. it reaches a temperature of at least 700° C. In that the tobacco filler is being microwave heated while being pneumatically transported in the arcuate path, heat is instantaneously lost from the tobacco to the transporting air. The walls of the arcuate path are in turn heated by contact with the air. It is thus part of the proposal of U.S. Pat. No. 3,664,351 that there is provided an electrically driven cooling fan.

SUMMARY OF THE INVENTION

It is an object of the subject invention to provide an effective method whereby tobacco rod can be made in a rod making machine with the tobacco filler suffering a reduced degree of degradation in the passage thereof through the rod making machine.

The subject invention provides a method of making tobacco rod wherein tobacco filler is fed continuously to a rod making machine, characterised in that at entry to the rod making machine said filler is at an elevated temperature as a result of said filler having been subjected to radio frequency heating.

The term "tobacco filler" as used herein shall be taken to include cut tobacco, cut reconstituted tobacco and cut tobacco substitute.

By "radio frequency" as used herein is meant a frequency within a range of from about 3 $MH_z$ to about 30 $MH_z$. An appropriate frequency for use in respect of the subject invention is 27.12 $MH_z$.

BRIEF DESCRIPTION OF THE DRAWING

The drawing depicts, by way of example, a side view of radio frequency heating means appropriate for use in respect to the subject invention.

DETAILED DESCRIPTION OF THE PREFERRED EMBODIMENTS OF THE INVENTION

The elevated temperature to which the tobacco filler is heated by the radio frequency heating could be, for example, that effected by an increment of at least about 45°C. above ambient.

Advantageously, the tobacco filler when being subject to the radio frequency heating is in the form of a continuous carpet on a conveyor, a belt conveyor for example. The downstream, outlet end of the conveyor belt may suitably be adapted to provide a more accurate dispensing of the heated tobacco filler, particularly if the filler is supplied to the bottom end of the feed hopper to the rod making machine to reduce the residence time of the tobacco filler in the feed hopper and hence to reduce the heat loss of the tobacco. With a belt conveyor it is appropriate for a first electrode of the radio frequency heater to be located beneath the upper, conveying run of the belt and a second electrode of the heater to be located above the conveying run. Each of the first and second electrodes may comprise one or more separate electrodes, which electrodes are laterally spaced from one another.

The radio frequency generator of the heater may be of, for example, an 8 kW rating.

In an alternative arrangement tobacco filler is radio frequency heated during the passage thereof down an upwardly extending feed duct. In such case the radio frequency heating means is arranged equi-angularly of the longitudinal axis of the duct. If the duct is of circular cross-section, a radio frequency heating electrode may be helically disposed of the duct.

The subject invention further provides apparatus comprising a tobacco rod making machine, feed means operable to feed tobacco filler to said machine, and radio frequency heating means operable to heat said filler at said feed means.

Preferably the radio frequency heating means is located in close proximity to the feed inlet of said rod making machine.

Preferably the apparatus also comprises enclosing means, such as a cabinet, disposed to enclose the radio frequency electrodes to prevent any leakage of radio frequency radiation. The enclosing means may also suitably incorporate protective means extending along a portion of said conveyor from the enclosing means.

The drawing herewith depicts, by way of example, radio frequency heating means appropriate for use in respect to the subject invention. In the drawing reference numeral 1 generally designates a support frame on which is supported an inclined, open ended box structure generally designated by reference numeral 2. Within the box structure 2 there is mounted a belt conveyor 3. A feed chute 4 is located at the lower, on-feed end of the conveyor 3. Extending across the upper run of the conveyor 3 close to the outlet of the chute 4 is a doffer drum 5.

An electrode 6 is mounted above the upper run of the conveyor 3 and an associated electrode 7 is mounted between the upper and lower runs of the conveyor 3. Electrodes 6 and 7 may alternatively each comprise three separate electrodes, each first electrode being matched with respect to the associated second electrode. A radio frequency generator 8 is supported by the frame 1 at a location beneath the box structure 2. Enclosing means 10 in the form of a cabinet encloses the radio frequency electrodes. Protective means 11 also extend from the cabinet some way along the conveyor 3.

In operation of the heating means the conveyor 3 is driven (by drive means not shown) in the direction of arrow A. A drive belt 9 causes the doffer drum 5 to rotate. Tobacco filler is fed down the chute 4 onto the upper run of the conveyor 3. The doffer drum 5 ensures that the carpet of filler on the conveyor 3 upstream of the drum 5 is of even depth. Radio frequency energy is fed to the electrodes 6, 7 from the generator 8 by conductor means (not shown). Thus as the carpet of tobacco filler passes between the electrode 6 and the electrode 7 the filler is heated. From the upper, off-feed end of the conveyor 3 the heated filler descends into the hopper of a cigarette maker (not shown). As discussed above the in-feed location of the heated filler may be varied. The heated filler remains in a heated condition during passage to the garniture of the rod maker, by which means degradation of the tobacco filler is reduced.

As will be appreciated by the man skilled in the art, the upper, lower and side walls of the box structure 2 can also serve to protect operators from radio frequency radiation.

We claim:

1. A method of making a tobacco rod, wherein tobacco filler is fed continuously to a rod making machine, which method comprises;

depositing tobacco filler onto a moving conveyor, feeding continuously said tobacco filler as a continuous carpet on said conveyor to
entry to the rod making machine; and applying heat to said filler of said carpet on said conveyor by radio frequency heating means before entry to the rod making machine;

said filler being at an elevated temperature, at entry to the rod making machine, as a result of said heating.

2. A method according to claim 1, wherein said tobacco filler is one or more of cut tobacco, cut reconstituted tobacco or cut tobacco substitute.

3. A method according to claim 1, wherein said frequency is 27.12 MHz.

4. A method according to claim 1, wherein said elevated temperature is at least about 45° C. above ambient.

5. Apparatus comprising a tobacco rod making machine, a conveyor and radio frequency heating means, means for depositing tobacco filler onto said conveyor, said conveyor being operable to feed continuously said tobacco filler as a continuous carpet to entry to said machine, said radio frequency heating means being operable to heat filler of said carpet on said conveyor so that said filler is at an elevated temperature at entry to said machine.

6. Apparatus according to claim 5, wherein said radio frequency heating means is located in close proximity to the feed inlet of said rod making machine.

7. Apparatus according to claim 5, wherein enclosing means is disposed to enclose said radio frequency electrodes.

* * * * *